US006994557B2

(12) United States Patent
Huscher et al.

(10) Patent No.: US 6,994,557 B2
(45) Date of Patent: Feb. 7, 2006

(54) ELECTRICAL CONNECTOR BETWEEN TWO END POINTS

(75) Inventors: Rainer Huscher, Waldershof (DE); Helmut Rebhan, Weiden (DE)

(73) Assignee: Nexans, Paris (FR)

( * ) Notice: Subject to any disclaimer, the term of this patent is extended or adjusted under 35 U.S.C. 154(b) by 52 days.

(21) Appl. No.: 10/320,435

(22) Filed: Dec. 17, 2002

(65) Prior Publication Data

US 2003/0124891 A1 Jul. 3, 2003

(30) Foreign Application Priority Data

Dec. 18, 2001 (DE) ..... 101 62 127

(51) Int. Cl.
*H01R 39/00* (2006.01)

(52) U.S. Cl. ..... 439/15; 439/164

(58) Field of Classification Search ..... 439/15, 439/164, 889, 890, 891; 200/61.54, 61.55
See application file for complete search history.

(56) References Cited

U.S. PATENT DOCUMENTS

| | | | | |
|---|---|---|---|---|
| 1,871,397 A | * | 8/1932 | Watts | 439/889 |
| 5,238,420 A | * | 8/1993 | Miyahara et al. | 439/164 |
| 5,348,490 A | * | 9/1994 | Schauer et al. | 439/164 |
| 5,429,517 A | * | 7/1995 | Bolen | 439/164 |
| 5,775,920 A | * | 7/1998 | Henderson | 439/15 |
| 2001/0030056 A1 | | 10/2001 | Sugata | |

FOREIGN PATENT DOCUMENTS

| | | |
|---|---|---|
| DE | 4000933 C2 | 7/1990 |
| DE | 42 21 238 A1 | 4/1993 |
| DE | 4221238 A1 | 4/1993 |
| DE | 4329117 C2 | 3/1995 |
| DE | 4404407 A1 | 8/1995 |
| DE | 19625388 A1 | 1/1997 |
| DE | 69214021 T2 | 4/1997 |
| EP | 0417350 B1 | 3/1991 |
| EP | 0 520 503 A2 | 12/1992 |

* cited by examiner

*Primary Examiner*—Tho D. Ta
(74) *Attorney, Agent, or Firm*—Sughrue Mion, PLLC

(57) ABSTRACT

An electrical connector between relatively movable end points, comprises a cassette having a stator which is stationary in the mounted position and a rotor which is rotatable relative to the stator about a common axis, the stator and rotor each bearing one of the end points. In the cassette, between the stator and the rotor, an electrical conductor (10) running in a coiled fashion is situated with its ends fixed to the end points in order to connect to continuing connecting lines. To simplify connection of the connecting lines, an identical electrical contact element is attached to each end of the conductor (10). The electrical contact element is provided with pins (22) which are suitable as contact pins for attaching a plug and as contact surfaces for fixedly connecting the conductors of a connection line.

2 Claims, 2 Drawing Sheets

ELECTRICAL CONNECTOR BETWEEN TWO END POINTS

This application is based on and claims the benefit of German Patent Application No. 10162127.2 filed Dec. 18, 2001, which is incorporated by reference herein.

BACKGROUND OF THE INVENTION

The invention relates to an electrical connector between two end points, one of which is movable relative to the other, comprising a cassette having a stator which is stationary in the mounted position and a rotor which is rotatable relative to the stator about a common axis, the stator and rotor each bearing one of the end points. In the cassette, between the stator and the rotor, an electrical conductor running in a coiled fashion is situated with its ends fixed to the end points in order to connect to continuing connecting lines. (European Patent 0 417 350 B1).

Such a connector is used, for example, for transmitting signals to deploy airbags provided in motor vehicles for collision protection, or for transmitting signals to other components in motor vehicles. For the transmission of the signals, the connector is mounted on the steering wheel of a motor vehicle. A significant problem associated with this use is the transmission of signals between stationary parts and the rotatable steering wheel of the motor vehicle. The sliding contacts or slip rings conventionally used are subject to wear, and in particular at low current intensity are hardly usable due to fluctuating contact resistances, which can result in faulty transmission.

For this reason, contactless connectors have been recently used which comprise a cassette having an electrical conductor running in a coiled fashion. The conductor is able to follow the movement of a steering wheel in both rotational directions without being damaged. According to the aforementioned European Patent 0 417 350 B1, for example, the conductor is coiled in a manner similar to the balance wheel of a watch, or, according to German Patent 196 25 388 A1, is divided into two mutually connected parts having opposite winding directions. Continuing connecting lines are either mounted with plugs or fixedly connected on the ends of the connector. Depending on the chosen connection method, both ends of the connector must be equipped, which is costly.

SUMMARY OF THE INVENTION

The object of the present invention is to design the aforementioned connector in such a way that the connection of continuing connecting lines can be simplified.

This object is achieved by the invention by mounting an identical electrical contact element on each end of the conductor, and providing the contact element with pins which are suitable as contact pins for attaching a plug and as contact surfaces for fixedly connecting the conductors of a connection line.

This connector has a particularly simple design. Its conductor is equipped with an identical contact element on each end. Thus, the contact element required need only be of a type which in each case can be attached in the same way to the ends of the conductor. In this manner the assembly of the connector is simplified, and the number of contact elements kept in inventory may be reduced. The connector is suited for all techniques for connecting continuing connecting lines. Plugs may be fitted on both ends, or conductors may be soldered on, for example. It is also possible to provide a plug-in connector at one end and a fixed connection on the other end. The contact element itself remains untouched by these.

BRIEF DESCRIPTION OF THE DRAWINGS

Exemplary embodiments of the subject matter of the invention are illustrated in the drawings, in which.

DETAILED DESCRIPTION OF THE INVENTION

Figure 1:
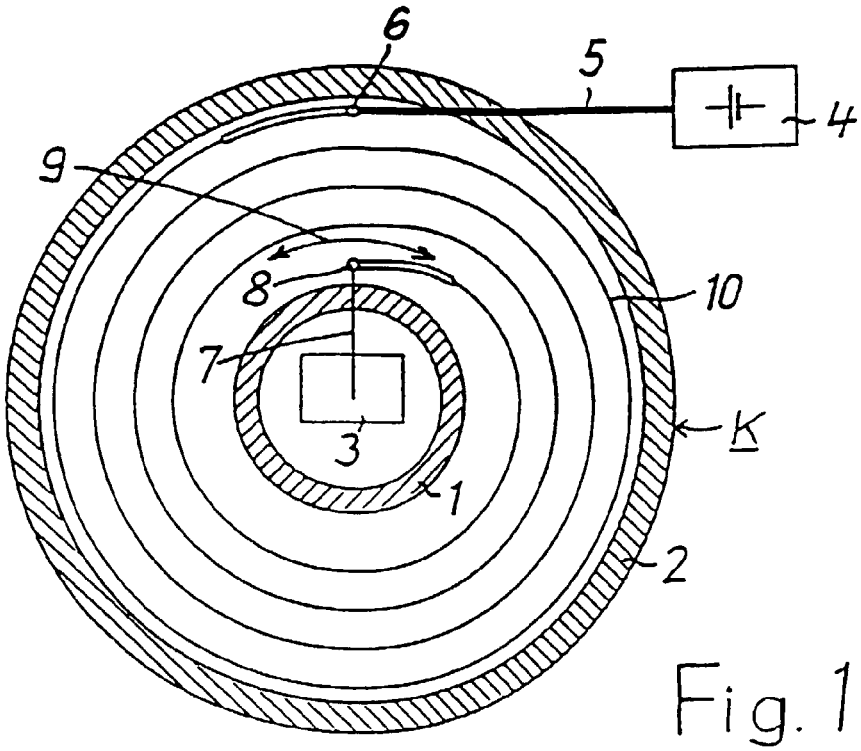
FIG. 1 is a schematic view of a cassette having a connector according to the invention.
Figure 3:
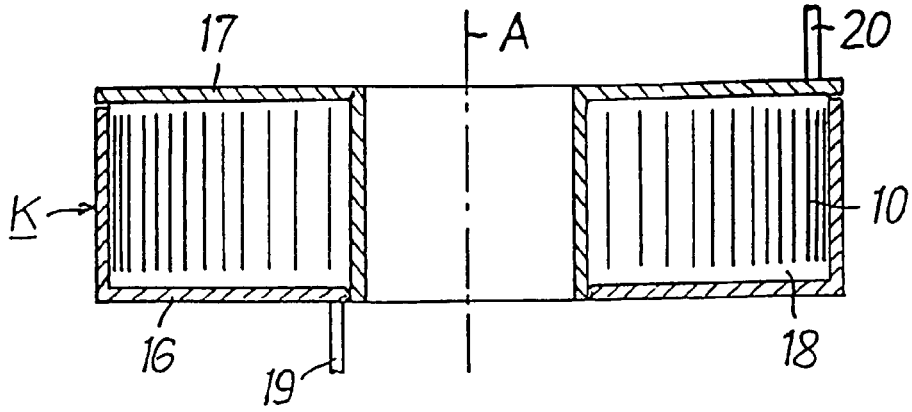
FIG. 3 is a schematic sectional representation through a cassette according to FIG. 1.

FIGS. 1 and 3 schematically show two walls 1 and 2 having a circular design, for example, of a cassette K comprising a stator 16 and a rotor 17 which is rotatable relative to the stator about a common axis A. The cassette is intended for installation in the steering wheel of a motor vehicle. To supply power to an electronic unit 3 by the signal of which an airbag can be deployed, cassette K is connected to a battery 4 in the motor vehicle. Battery 4 is connected via an electrical connecting line 5 to an end point 6 which is situated on stator 16 of the cassette and designed as a stationary point. Electronic unit 3 is connected via an electrical connecting line 7 to an end point 8 of cassette K, the end point being movable along with rotor 17 of cassette K in the direction of double arrow 9. In principle, end point 8 could be stationary and end point 6 could be movable, with a correspondingly different arrangement with respect to stator 16 and rotor 17 of cassette K.

Figure 4:
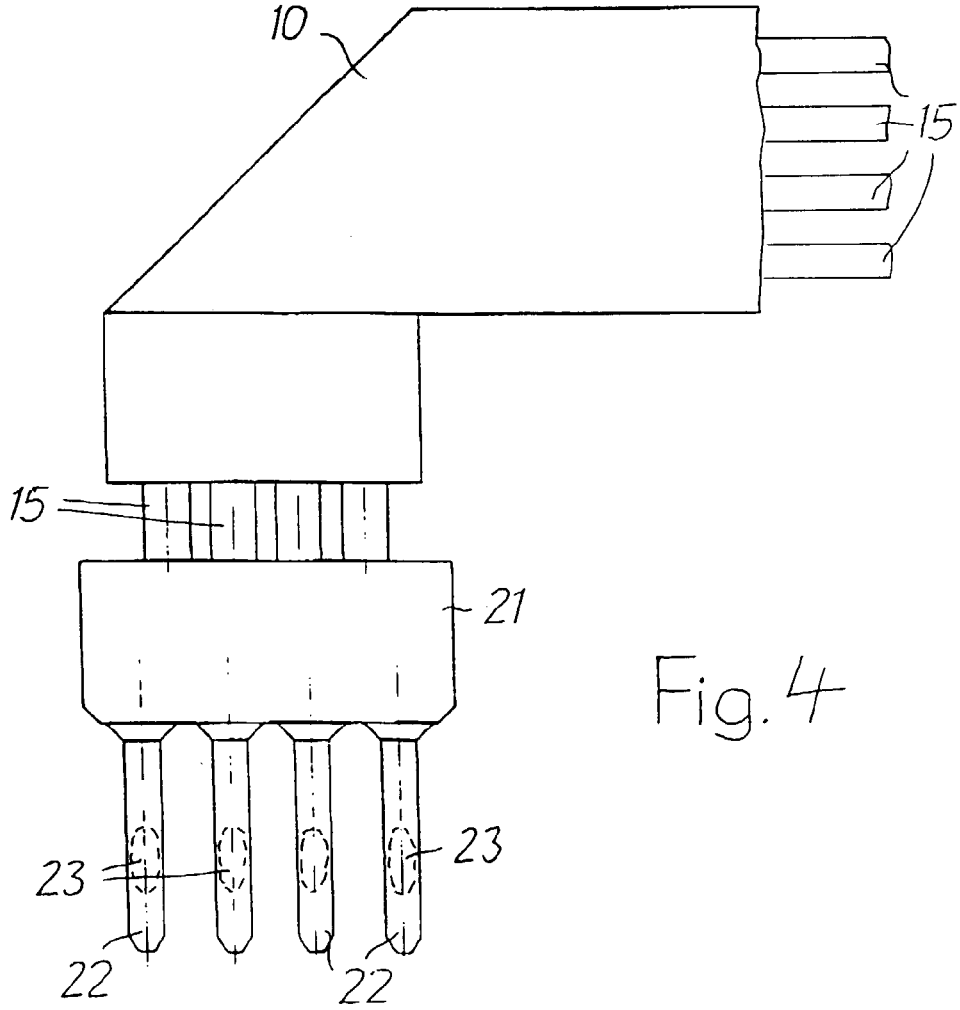
FIG. 4 shows one end of a conductor situated in the cassette, in an enlarged illustration.

An electrical conductor 10, referred to hereinafter as "FBL 10", having at least two electrical conductors 15 is attached between the two end points 6 and 8 (FIG. 4). Conductors 15 preferably are designed as flat conductors. This embodiment of FBL 10 is particularly thin and therefore takes up very little space. In principle, however, FBL 10 could also have round conductors.

As shown in FIG. 1, FBL 10 can be situated in cassette K between the two end points 6 and 8 in multiple turns, in the manner of a barrel in a watch. Although the number of revolutions of a steering wheel is limited to approximately six revolutions, more than six turns are to be provided for FBL 10. Thus, for a single turn of FBL 10 the rotational motion of end point 8 is not appreciably noticeable. The diameter of the winding element comprising all the turns of FBL 10 is merely reduced in one rotational direction of the steering wheel, and increased in the other rotational direction.

Figure 2:
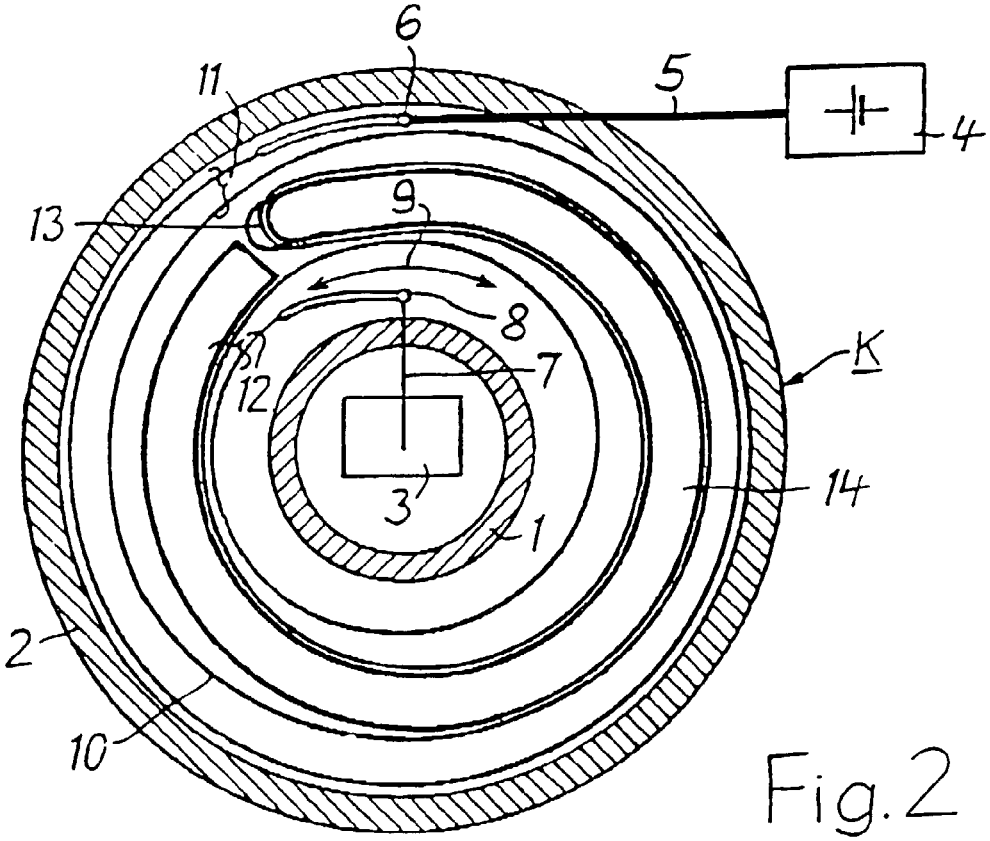
FIG. 2 shows an embodiment of the cassette modified from FIG. 1.

As shown in FIG. 2, FBL 10 may also be arranged in cassette K in turns which are divided into an outer winding area 11 and an inner winding area 12. Both winding areas 11 and 12 are indicated by brackets in the figure. In the central position shown in FIG. 2 or in the mounted position of cassette K, the winding areas each comprise two to three turns. The turns of FBL 10 have opposite winding directions in winding area 11 as compared to winding area 12. Winding areas 11 and 12 are connected to one another by an essentially U-shaped reversal point 13. A circular one-part guide element 14 encompassing reversal point 13 may be mounted between the two winding areas 11 and 12.

Guide element 14 is rotatable about its center point, and is slightly movable in the circumferential direction of cassette K in the direction of double arrow 9. The guide element may be designed, for example, as a closed ring having a passage for reversal point 13 of FBL 10. Guide element 14 is preferably made of plastic. For this reason the guide element is very light, making it very easy to be moved in cassette K.

As shown in FIG. 3, cassette K comprises a stator 16 and a rotor 17. Rotor 17 is rotatable relative to stator 16 about common axis A. The rotor is thus connected for example to the steering wheel of a motor vehicle in which cassette K is installed. FBL 10 is situated in the accommodating space 18 enclosed by rotor 17 and stator 16.

Continuing electrical connecting lines 19 and 20 leading from cassette K are connected to the ends of FBL 10. Such connecting lines may be, for example, connecting lines 5 and 7 mentioned above. For the electrically conductive connection of connecting lines 19 and 20 with FBL 10, the latter is provided on both ends with identical contact elements 21. An example of such a contact element 21 is shown in FIG. 4.

FIG. 4 shows one end of an FBL 10 in the illustrated exemplary embodiment which is provided with four flat conductors 15 preferably made of copper. FBL 10 is bent at an angle of 90° on this end. Contact element 21, which in the present case has four pins 22, is attached on the free end of the bent-down area of FBL 10. Each of pins 22 is connected in an electrically conductive manner to a conductor 15 of FBL 10. Contact element 21 could also be attached to FBL 10 if the latter were not bent.

Pins 22 may be used as contact pins for attaching a plug and as contact surfaces for fixedly connecting electrical conductors. The pins can be conically tapered at their free ends, thereby making it easier to attach one of the plugs mounted on a connecting line 19 or 20. Pins 22 have a length greater than that required for attaching a plug. In this manner contact surfaces 23, indicated in the figure by dashed lines, are present which are large enough to attach electrical conductors of a connecting line 19 or 20, for example by soldering or welding.

What is claimed is:

1. An electrical connector between two end points, one of which is movable relative to the other, comprising:

a cassette having a stator which is stationary in a mounted position of the cassette and a rotor which is rotatable relative to the stator about a common axis, the stator and rotor each bearing one of the end points, and in the cassette, between the stator and the rotor, an electrical line having at least two electrical conductors running in windings is positioned with its ends fixed to the end points in such a manner that connecting lines can be connected to the electrical line, said connector further comprising:

identical electrical contact elements connected on each end of the line to the conductors of the line, wherein said contact elements are pins which simultaneously are either contact pins to be inserted into a plug or are contact elements for fixedly connecting the conductors of a connecting line; and wherein the pins have a length greater than that required for establishing contact with a plug, and are provided with contact surfaces along their length, which contact surfaces are provided for the fixedly connecting of the conductors of the connecting line.

2. A connector according to claim 1, wherein free ends of the pins are conically tapered.

* * * * *